US011592784B2

(12) United States Patent
Born et al.

(10) Patent No.: US 11,592,784 B2
(45) Date of Patent: Feb. 28, 2023

(54) BEARING, PARTICULARLY A SHOCK ABSORBER, AND ROTARY WHEEL SET OF A TIMEPIECE MOVEMENT

(71) Applicant: The Swatch Group Research and Development Ltd, Marin (CH)

(72) Inventors: Jean-Jacques Born, Morges (CH); Dominique Lechot, Les Reussilles (CH); Yves Winkler, Schmitten (CH); Christophe Vincent, Montperreux (FR)

(73) Assignee: The Swatch Group Research and Develonment Ltd, Marin (CH)

( * ) Notice: Subject to any disclaimer, the term of this patent is extended or adjusted under 35 U.S.C. 154(b) by 635 days.

(21) Appl. No.: 16/713,079

(22) Filed: Dec. 13, 2019

(65) Prior Publication Data

US 2020/0201259 A1 Jun. 25, 2020

(30) Foreign Application Priority Data

Dec. 20, 2018 (EP) ..... 18214830

(51) Int. Cl.
*G04B 31/02* (2006.01)
*G04B 13/02* (2006.01)
*G04B 31/012* (2006.01)

(52) U.S. Cl.
CPC ..... *G04B 31/02* (2013.01); *G04B 13/02* (2013.01); *G04B 31/012* (2013.01)

(58) Field of Classification Search
CPC ..... G04B 13/02; G04B 31/02; G04B 13/021; G04B 31/012; F16C 17/08
See application file for complete search history.

(56) References Cited

U.S. PATENT DOCUMENTS 2,300,362 A * 10/1942 Shotter ..... G01R 11/12 384/245
3,036,871 A * 5/1962 Matthey ..... G04B 31/02 968/282

(Continued)

FOREIGN PATENT DOCUMENTS

CH 305 508 A 2/1955
CN 103048912 A 4/2013

(Continued)

OTHER PUBLICATIONS

European search report for No. 18214830 dated Jun. 17, 2019.

(Continued)

*Primary Examiner* — Sean Kayes
(74) *Attorney, Agent, or Firm* — Sughrue Mion, PLLC

(57) ABSTRACT

A bearing for an arbor or staff of a rotary wheel set of a timepiece movement, the bearing including a bearing block provided with a housing and an endstone arranged inside the housing, the endstone having a main body provided with a cavity configured to receive a pivot of the arbor of the rotary wheel set, the pivot having the shape of a first cone having a first solid angle, the apex of the first cone being rounded with a predefined first radius of curvature in a range from 0.2 μm to 50 μm, the cavity having a second cone shape with a second solid angle, greater than the first solid angle, so that the pivot can rotate in the cavity, the apex of the second cone being rounded and having a predefined second radius of curvature. The second radius of curvature is smaller than the first radius of curvature.

18 Claims, 3 Drawing Sheets

(56) References Cited

U.S. PATENT DOCUMENTS

| | | | | |
|---|---|---|---|---|
| 3,050,350 | A * | 8/1962 | Loretan | G04B 31/02 968/282 |
| 3,132,907 | A * | 5/1964 | Guignard | G04B 31/02 968/282 |
| 3,790,237 | A * | 2/1974 | Quaile | G04B 31/02 29/898.15 |
| 3,942,848 | A * | 3/1976 | Voumard | G04B 31/02 968/282 |
| 2004/0065412 | A1 | 4/2004 | Ensinger | |
| 2011/0164478 | A1 | 7/2011 | Conus et al. | |
| 2013/0028056 | A1* | 1/2013 | Cettour-Baron | G04B 17/063 368/169 |
| 2013/0188462 | A1 | 7/2013 | Helfer et al. | |
| 2016/0041526 | A1* | 2/2016 | Stranczl | G04B 31/06 368/326 |

FOREIGN PATENT DOCUMENTS

| | | | |
|---|---|---|---|
| CN | 103124935 | A | 5/2013 |
| CN | 103988133 | A | 8/2014 |
| CN | 203930351 | U | 11/2014 |
| CN | 107490950 | A | 12/2017 |
| CN | 207133591 | U | 3/2018 |
| EP | 1 986 059 | A1 | 10/2008 |
| EP | 3 382 472 | A1 | 10/2018 |
| FR | 1 333 053 | A | 7/1963 |
| JP | 48-4508 | Y | 2/1973 |
| JP | 6-45278 | Y2 | 11/1994 |
| JP | 2006-502016 | A | 1/2006 |
| JP | 2010-539440 | A | 12/2010 |
| JP | 2013-529778 | A | 7/2013 |
| JP | 2013-170821 | A | 9/2013 |
| WO | 2013/087173 | A1 | 6/2013 |

OTHER PUBLICATIONS

Office Action dated Jun. 15, 2021 issued by the Chinese Patent Office in Chinese Application No. 201911329064.5.

Communication dated Feb. 9, 2021, issued by the Japanese Patent Office in application No. 2019-224233.

* cited by examiner

BEARING, PARTICULARLY A SHOCK ABSORBER, AND ROTARY WHEEL SET OF A TIMEPIECE MOVEMENT

CROSS-REFERENCE TO RELATED APPLICATIONS

This application claims priority to European Patent Application No. 18214830.4, filed on Dec. 20, 2018, the entire contents of which are incorporated herein by reference.

FIELD OF THE INVENTION

The present invention concerns a bearing for a timepiece movement, particularly a shock absorber, for an arbor or staff of a rotary wheel set. The invention also relates to a rotary wheel set of a timepiece movement. The invention also relates to a timepiece movement provided with such a bearing and such a rotary wheel set.

BACKGROUND OF THE INVENTION

In timepiece movements, the arbors or staffs of the rotary wheel sets generally have pivots at their ends, which rotate in bearings mounted on the plate or in bars of a timepiece movement. For some wheel sets, in particular the balance, it is customary to equip the bearings with a shock absorber mechanism. Indeed, as the balance staff pivots are generally thin and the mass of the balance is relatively high, the pivots can break under impact in the absence of a shock absorber mechanism.

The configuration of a conventional shock absorber bearing 1 is represented in FIG. 1. A domed olive hole jewel 2 is driven into a bearing support 3, commonly called a 'setting', on which is mounted an endstone 4. Setting 3 is held resting against the bottom of a bearing block 5 by a shock absorber spring 6, arranged to exert an axial stress on the upper part of endstone 4. Setting 3 further includes an external conical wall arranged in correspondence with an inner conical wall disposed at the periphery of the bottom of bearing block 5. Variants also exist wherein the setting has an external wall having a surface of convex, i.e. domed, shape.

However, there are friction problems which causes differences in the angle of rotation of the staff depending on the position in which the rotary wheel set is located with respect to gravity. Indeed, when the staff is perpendicular to the direction of gravity, it rubs more strongly against domed olive hole jewel 2, such that the angle of rotation of the balance is decreased compared to the angle formed when it is parallel to the direction of gravity. The precision of the movement is consequently reduced by this difference.

To control this problem, another shock absorber bearing was devised, partly represented in FIG. 2. Bearing 10 has an endstone 7 of the cup-bearing type, including a cone-shaped cavity 8 for receiving a pivot 12 of the arbor 9 of the rotary wheel set, the bottom of the cavity being formed by the apex 11 of the cone. Pivot 12 is also conical for insertion into cavity 8, but the solid angle of pivot 12 is smaller than that of the cone of cavity 8. This configuration makes it possible to control the difference in friction, such that the difference in angle between the aforecited positions is much less. Indeed, as a result of this geometry, in the position perpendicular to the direction of gravity, friction is lower.

However, this type of bearing has a significant drawback concerning the centring of the arbor relative to the cup-bearings. Indeed, it is not possible to obtain proper centring in the current configurations of this type of shock absorber. There is therefore a significant risk of the arbor being jammed between the cup-bearings that hold the arbor of the rotary wheel set on either side.

SUMMARY OF THE INVENTION

It is consequently an object of the invention to propose a bearing, particularly a shock absorber, for an arbor of a rotary wheel set of a timepiece movement, for example a balance staff, which avoids the aforecited problem. Such a bearing makes it possible to properly centre the arbor in the cup-bearing.

To this end, the invention concerns a bearing comprising a bearing block provided with a housing and an endstone arranged inside the housing, the endstone having a main body provided with a cavity configured to receive a pivot of the rotary wheel set arbor, the pivot having a first cone shape with a first solid angle, the apex of the first cone being rounded with a predefined first radius of curvature comprised in a range from 5 μm to 50 μm, the cavity having a second cone shape with a second solid angle, greater than the first solid angle, so that the pivot can rotate in the cavity, the apex of the second cone being rounded and having a predefined second radius of curvature, characterized in that the second radius of curvature is smaller than the first radius of curvature.

The bearing is characterized in that the second radius of curvature is smaller than the first radius of curvature.

Thus, the pivot is properly held inside the endstone cavity to prevent the arbor being jammed in the bearing, while still leaving it free to rotate. Indeed, when the radius of curvature of the cavity bottom is greater than that of the arbor pivot, the pivot can be decentred in the bottom of the cavity and cause the arbor to jam, such that the balance is braked or completely blocked. With a smaller radius of curvature of the cavity bottom than that of the arbor pivot, the pivot remains centred in the cavity, whatever the movement or position of the timepiece.

Further, this configuration of the endstone makes it possible to maintain constant pivot friction inside the endstone, whatever the position of the arbor with respect to the direction of gravity, which is important, for example, for a balance staff of a timepiece movement. The cone shape of the cavity and of the pivot minimises the difference in friction in the various positions of the arbor relative to the direction of gravity.

Specific embodiments of the bearing are defined in the dependent claims 2 to 15.

According to an advantageous embodiment, the second radius of curvature is less than 40 μm.

According to an advantageous embodiment, the second radius of curvature is less than 30 μm.

According to another advantageous embodiment, the second radius of curvature is less than 20 μm.

According to another advantageous embodiment, the second radius of curvature is less than 10 μm.

According to another advantageous embodiment, the second radius of curvature is substantially equal to 4 μm.

According to another advantageous embodiment, the second radius of curvature is at least equal to 0.1 μm.

According to another advantageous embodiment, the second radius of curvature is at least equal to 1 μm.

According to a preferred embodiment, the main body of the endstone is formed of a material to be chosen from the following list: an alloy of an at least partially amorphous metal, an electroformed material, or a synthetic material.

According to one embodiment, the cavity is obtained from a hot deformation process of an at least partially amorphous metal using a tool whose diameter is smaller than the first radius of curvature of the first cone.

Advantageously, the second solid angle is comprised in a range from 60 to 120°, or 80 to 100°, preferably equal to 90°.

According to one embodiment, the at least partially amorphous metal alloy is crystallised to create friction-enhancing phases.

Advantageously, the at least partially amorphous metal alloy is ceramized to harden the main body surface, especially in the second cone of the cavity.

According to one embodiment, the main body of the endstone is produced by a galvanic growth process, such as electroforming, in a corresponding mold.

According to one embodiment, the main body of the endstone made of synthetic material, for example of the POM type, is obtained by moulding.

According to one embodiment, the main body of the endstone made of composite material, for example of the POM type, reinforced with particles of a friction-reducing material, for example PTFE, is obtained by moulding.

Advantageously, it includes a resilient endstone support, such as a spring, to dampen shocks.

According to one embodiment, the main body of the endstone and the resilient support are formed in one piece.

According to one embodiment, the resilient support is formed by a LIGA-type lithography, electroplating and moulding process.

According to one embodiment, the main body of the endstone is overmoulded on the resilient support.

According to one embodiment, the first radius of curvature is comprised in a range from 0.2 μm to 35 μm.

According to one embodiment, the first solid angle of the first cone is comprised in a range from 0.2 μm a 25 μm.

According to one embodiment, the first solid angle of the first cone is comprised in a range from 0.2 μm to 15 μm.

The invention also relates to a rotary wheel set of a timepiece movement, such as a balance, for a bearing according to the invention, the wheel set being provided with an arbor or staff having at least one pivot with a first cone shape with a predefined first solid angle, the apex of the first cone being rounded and having a predefined first radius of curvature. The wheel set is characterized in that the first radius of curvature is comprised in a range from 0.2 μm to 50 μm.

According to an advantageous embodiment, the first radius of curvature is comprised in a range from 0.2 μm to 35 μm.

According to an advantageous embodiment, the first radius of curvature is comprised in a range from 0.2 μm to 25 μm.

According to an advantageous embodiment, the first radius of curvature is comprised in a range from 0.2 μm to 15 μm.

A particular shape of the rotary wheel set is defined in claim 17, wherein the first cone apex of the pivot is cut to form a circular third cone, having a third solid angle greater than the first solid angle.

Advantageously, the third solid angle is substantially equal to the second angle of the endstone.

The invention also relates to a timepiece movement comprising a plate and at least one bar, said plate and/or the bar comprising an orifice. The movement is characterized in that it includes a bearing according to the invention inserted into the orifice and a rotary wheel set according to the invention.

BRIEF DESCRIPTION OF THE DRAWINGS

Other features and advantages of the present invention will appear upon reading the description of several embodiments given purely by way of non-limiting examples, with reference to the annexed drawings, in which.

DETAILED DESCRIPTION OF PREFERRED EMBODIMENTS

A bearing and an arbor of a rotary wheel set will be described according to two embodiments, with the same numbers used to designate identical objects. In a timepiece movement, the bearing is used to hold an arbor of a rotary wheel set, for example a balance staff, while allowing it to rotate about its axis. The timepiece movement generally includes a plate and at least one bar, not represented in the Figures, said plate and/or the bar comprising an orifice, the movement further including a rotary wheel set and a bearing inserted into the orifice.

Figure 1:
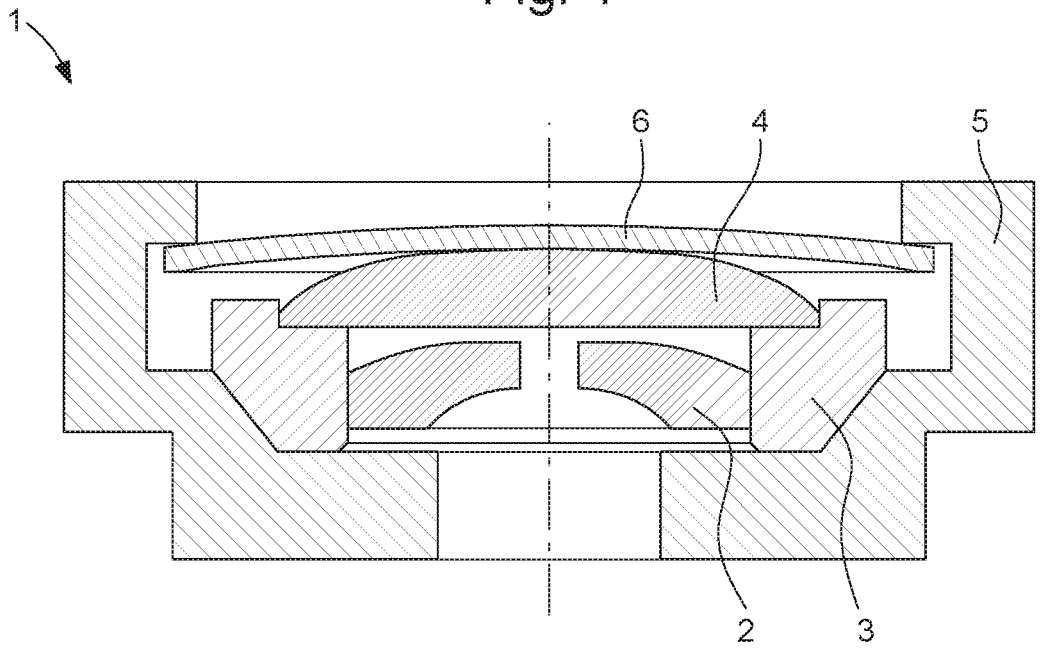
FIG. 1 represents a cross-section of a shock absorber support bearing for a rotary wheel set arbor according to a first state of the art embodiment.
Figure 2:
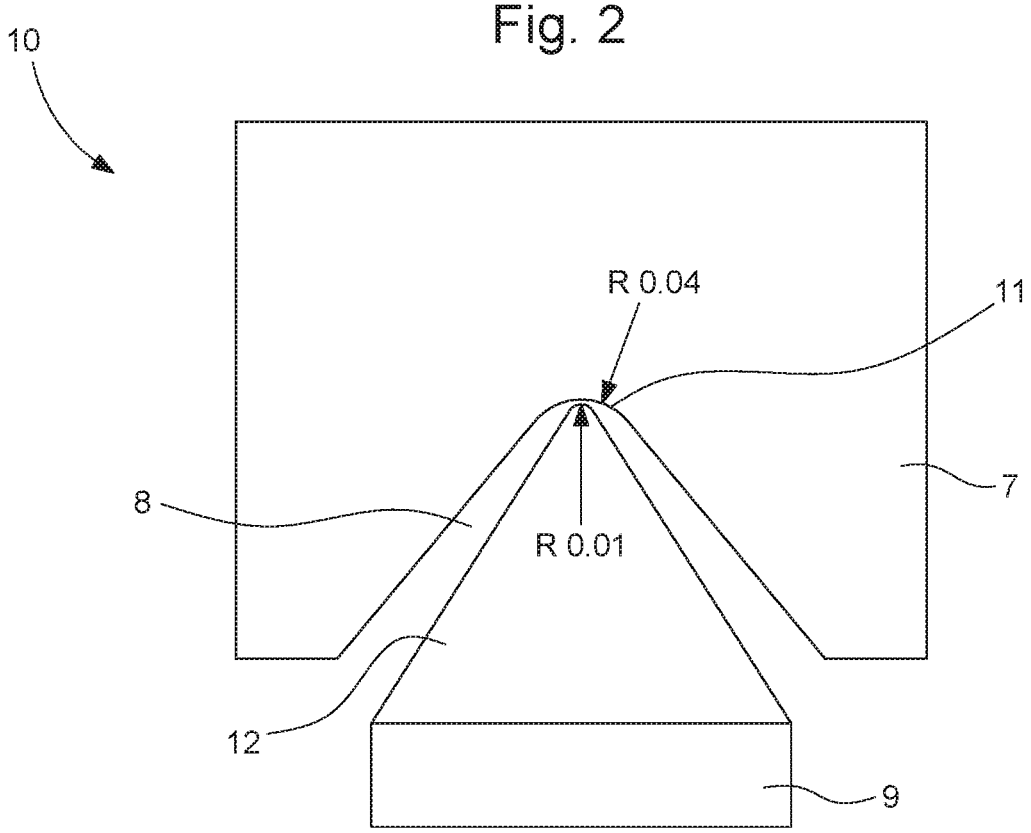
FIG. 2 schematically represents an endstone of a bearing and a pivot of a rotary wheel set arbor according to a second state of the art embodiment.
Figure 3:
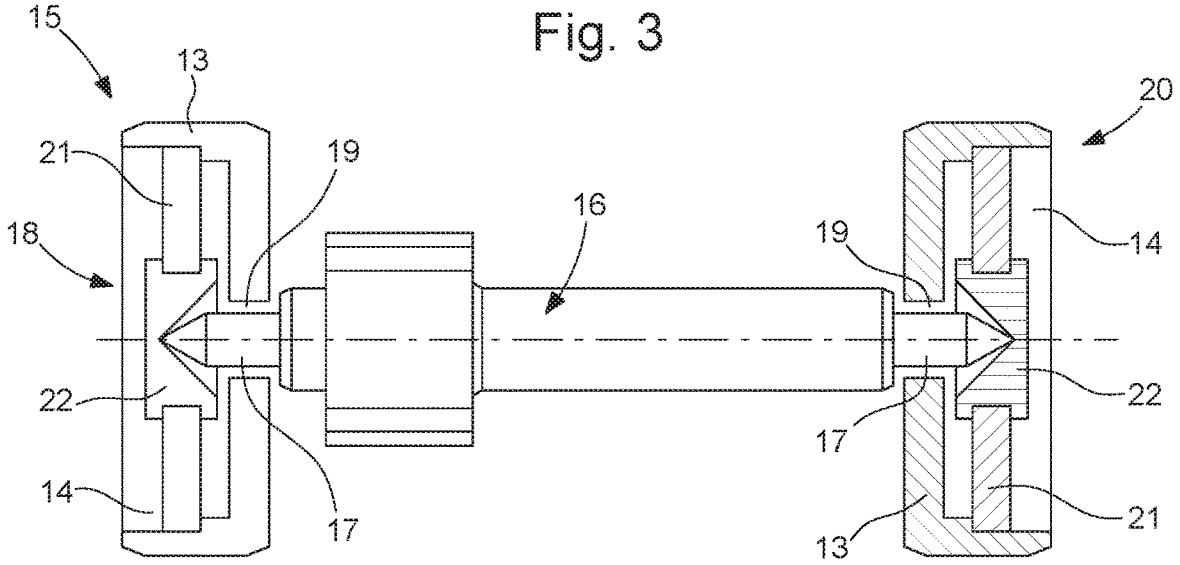
FIG. 3 schematically represents a cross-section of part of a timepiece movement including a balance staff held by two bearings according to the invention.

FIG. 3 shows a part 15 of a timepiece movement comprising two bearings 18, 20 and a balance staff 16 held at each end by two bearings 18, 20. Staff 16 has a pivot 17 at each end, the pivots being formed of a hard material, preferably ruby. Each bearing 18, 20 includes a cylindrical bearing block 13 provided with a housing 14, an endstone 22 arranged inside housing 14, and an opening 19 made in one face of bearing 18, 20, opening 19 leaving a passage for insertion of pivot 17 into the bearing as far as endstone 22. Endstone 22 has a main body provided with a cavity configured to receive pivot 17 of the staff of the rotary wheel set. Pivots 17 of staff 16 are inserted into housing 14, staff 16 being held but still able to rotate to allow the motion of the rotary wheel set.

Figure 4:
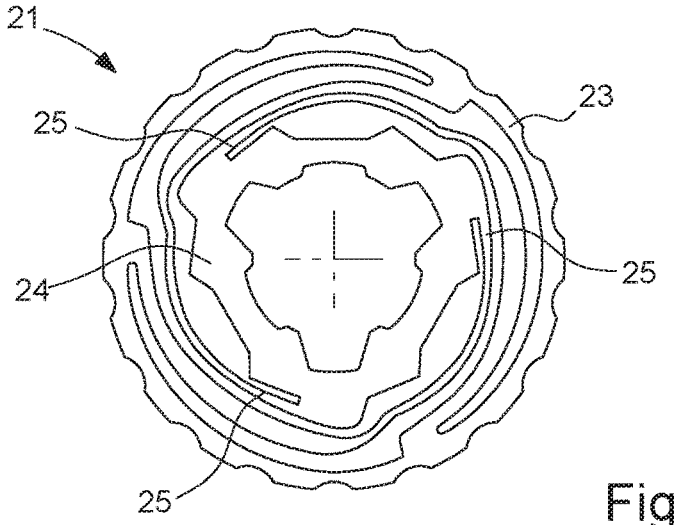
FIG. 4 represents a schematic view of a resilient support for a shock absorber bearing according to the invention.

The two bearings 18, 20 are shock absorbers and also comprise a resilient support 21 for endstone 22 to dampen shocks and prevent staff 16 from breaking. A resilient support 21, represented in FIG. 4, is, for example, a flat spring with axial and radial deformation on which endstone 22 is assembled. Resilient support 21 is fitted inside housing 14 of bearing block 13 and it holds endstone 22 suspended inside housing 14. Thus, when the timepiece is subject to a violent shock, the spring absorbs the shock and protects staff 16 of the rotary wheel set. Resilient support 21 has a spiral shape with several strands 25 (three here), each strand 25 connecting a rigid central ring 24 to a rigid peripheral ring 23. Peripheral ring 23 is fitted inside housing 14 of bearing block 13 and held by one or more inner faces of the bearing block 13 of FIG. 3. Endstone 22 is fitted inside central ring 24 of resilient support 21. The material and thickness of the resilient support are chosen to allow deformation thereof by a large force, for example following a shock which may produce a force of 100 G or 200 G, one G being the Earth's gravitational pull.

Figure 5:
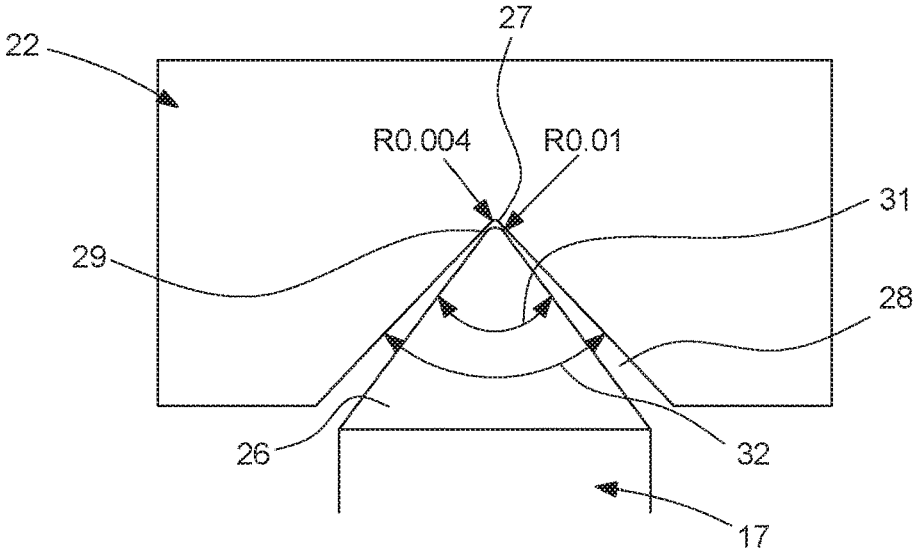
FIG. 5 represents an endstone of a support bearing and a pivot of a rotary wheel set arbor according to a first embodiment of the invention.

In a first embodiment of FIG. 5, pivot 17 has the shape of a substantially circular first cone 26 with a first solid angle 31. Solid angle 31 is the angle formed inside the cone by its external wall. Apex 29 of first cone 26 is also rounded with a predefined first radius of curvature to allow rotation of pivot 17. The first radius of curvature is comprised in a range, for example, from 0.2 μm to 40 μm, or from 0.2 μm to 25 μm, preferably from 0.2 μm to 15 μm. In FIG. 3, the first radius of curvature is equal to 10 μm.

The cavity of endstone 22 has the shape of a second cone 28 with a second solid angle 32 at the apex. In order for pivot 17 to be able to rotate inside the cavity, second solid angle 32 is greater than first solid angle 31 of first cone 36. Preferably, second cone 28 has a second solid angle 32 comprised in a range from 60 to 120°, or 80 to 100°. Second solid angle 32 is substantially equal to 90° in FIG. 3, since this is the angle that provides substantially equal friction in the different positions of the staff relative to the direction of gravity, as previously explained. Apex 27 of second cone 28 is also rounded and has a predefined second radius of curvature. The curvatures of apexes 27, 29 of the two cones 26, 28 facilitate the rotation of pivot 17 in endstone 22.

According to the invention, the second radius of curvature 27 of second cone 28 of endstone 22 is smaller than first radius of curvature 29 of first cone 26 of pivot 19. This therefore avoids any decentring of pivot 19 in endstone 22 and hence the risk of the staff jamming. The second radius of curvature is, for example, less than 40 μm, or less than 30 μm, or less than 20 μm, or less than 10 μm. The second radius of curvature is preferably at least equal to 0.1 μm, or greater than 1 μm.

In the first embodiment, represented in FIG. 5, the second radius of curvature is equal to 4 μm, while the first radius of curvature is 10 μm. Such radii of curvature improve the centring of pivot 17 in the cavity and further avoid the risk of decentring the staff between bearings 22.

In a variant (not represented in the Figures) the second radius of curvature of the endstone is equal to 10 μm, while the first radius of curvature is 15 μm.

Other examples of values are of course possible, provided that the second radius of curvature is smaller than the first radius of curvature. Preferably, these values lie within one of the aforementioned ranges.

Figure 6:
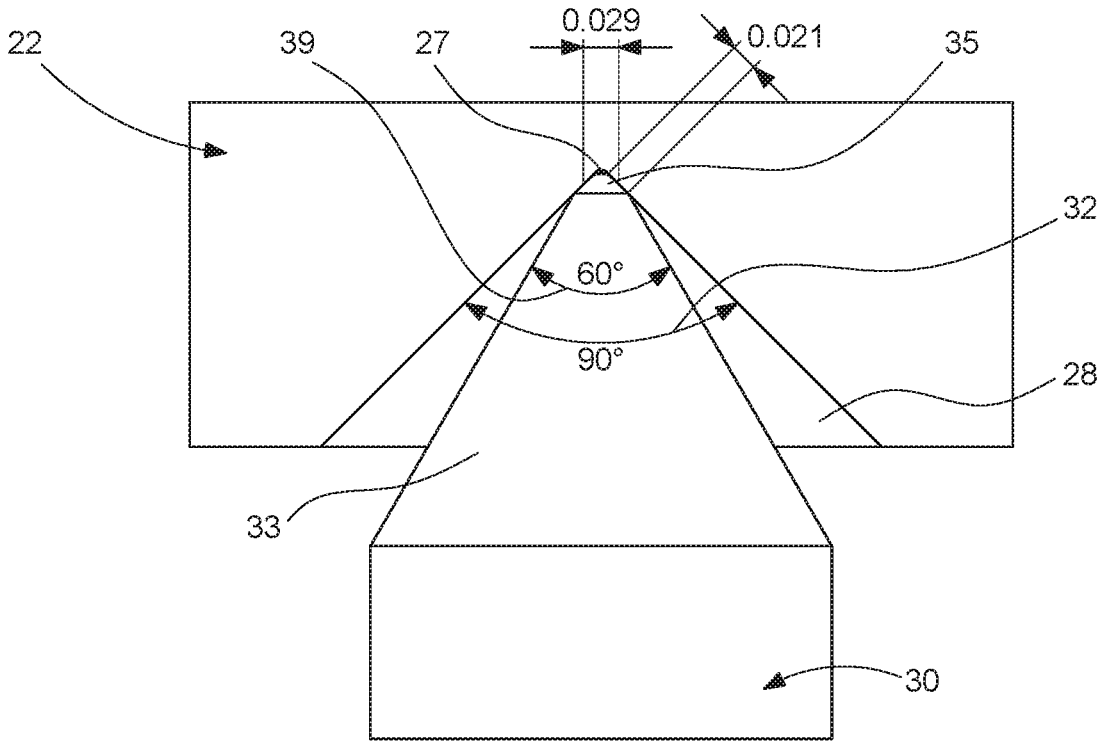
FIG. 6 schematically represents an endstone of a support bearing and a pivot of a rotary wheel set arbor according to a second embodiment of the invention.
Figure 7:
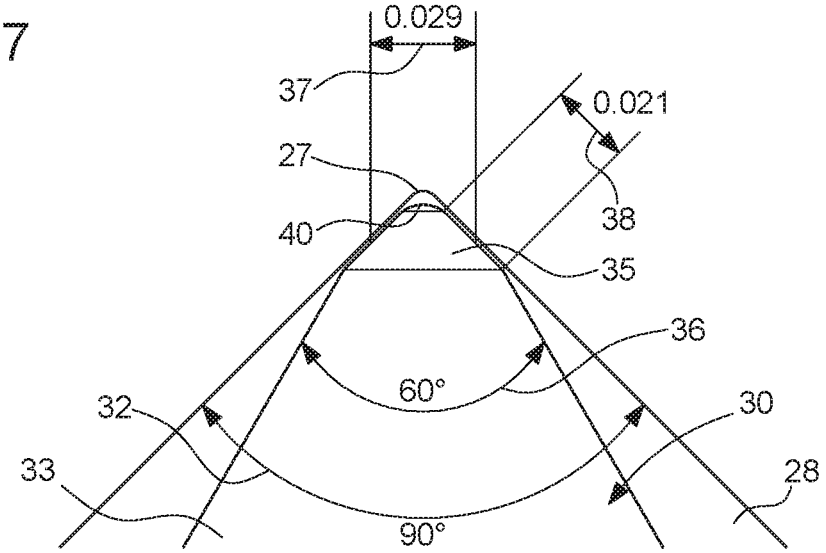
FIG. 7 schematically represents an enlarged view of the endstone and of the pivot of the second embodiment of the invention.

In a second embodiment of the timepiece movement of FIGS. 6 and 7, endstone 22 is the same as that of the first embodiment, but pivot 30 is different. Indeed, the apex 40 of first cone 33 of pivot 30 is cut again to form a circular third cone 35, having a third solid angle 42 substantially equal to the second solid angle 32 of second cone 28 of endstone 22. In the example, the second solid angle 32 and third solid angle 42 are 90°. The third cone 35 is restricted around apex 40 of pivot 30. In FIGS. 6 and 7, third cone 35 has a mean diameter 37 of 29 μm and a lateral radius 38 of 21 μm, while the height of the first cone is, for example, 500 μm. First cone 33 forms the body of pivot 30, but it is truncated at its apex by third cone 35 whose solid angle 42 is different in order to fit the cavity of endstone 22. Third cone 35 has the same rounded apex with the same radius of curvature as first cone 26 of the first embodiment of FIG. 5, to maintain the same advantages. Thus, additionally, the connection between pivot 30 and endstone 22 is improved by slightly increasing the area of friction, to prevent premature wear of pivot 30 and of endstone 22.

To obtain such a small second radius of curvature in a conical cavity of an endstone, the material used to make the endstone body must be specifically selected. Indeed, materials conventionally used to make endstones are too hard to obtain such a radius of curvature. For example, the machining of a ruby or steel material allows second radii of curvature in the endstone cavity of more than 40 μm to be obtained, since the tool used to make the cavity must be sufficiently thick not to break during the machining of the main endstone body.

Thus, for the two embodiments of the invention, the main body of the endstone is formed of a material to be chosen from the following list: an at least partially amorphous metal alloy, an electroformed material, a synthetic material or a composite material.

In a first preferred embodiment for forming the endstone, the main body is formed of an at least partially amorphous metal containing a metal element. This metal element may be a conventional metal element of the iron, nickel, zirconium, titanium or aluminium type, or a precious metal element such as gold, platinum, palladium, rhenium, ruthenium, rhodium, silver, iridium or osmium. An 'at least partially amorphous material' means that the material is capable of at least partially solidifying in amorphous phase, i.e. it is subject to an increase in temperature above its melting temperature causing it to lose any local crystalline structure locally, said increase being followed by cooling to a temperature lower than its glass transition temperature allowing said material to become at least partially amorphous.

The amorphous metal is, for example, chosen from the following compositions: zirconium (Zr)-based Zr58.5Cu15.6Ni12.8Al0.3Nb2.8, palladium (Pd)-based Pd43Cu27Ni10P20, or platinum (Pt)-based Pt57.5Cu14.7Ni5.3P22.5. Other amorphous metal compositions can evidently be used, and the invention is not limited to these examples. The cavity is thus obtained by a hot deformation process. The amorphous metal is heated to a temperature higher than its glass transition temperature which considerably reduces its viscosity and thus makes it possible to faithfully replicate the tool on which it is deformed. The tool will have been pre-machined to have a conical shape whose radius of curvature is substantially equal to the desired second radius of curvature. Thus, the second radius of curvature is smaller than the first radius of curvature. Owing to the use of amorphous metal, the tool is not subject to wear during the forming process and thus maintains its original radius, unlike the case of the machining of very hard materials such as ruby or tempered steel. Consequently, smaller radii of curvature are obtained, like those required for the endstone of the invention. In order to improve tribological properties, the endstone can be crystallised to create friction-enhancing phases.

Advantageously, in this embodiment, the amorphous metal can be ceramized to improve tribological properties and thus harden the surface of the main body, in particular in the second cone of the cavity. Thus, wear due to friction of the e.g. ruby pivot of the arbor is reduced as a result of ceramization. The surface treatment consists in forming a ceramic type layer on this surface. There are several possible means (chemical, thermal, plasma, etc.) of forming this layer. For example, a surface layer of ZrO2 or ZrC or ZrN is obtained for a zirconium (Zr)-based amorphous metal.

In a second embodiment for forming the main body, the main body of the endstone is formed by an electroformed material, for example of the Ni, Ni—P, Ni—Co, Pd, Pd—Co, Pt, Au750, Au9ct type, or otherwise. Galvanic growth is carried out in a corresponding mold. Thus, the mold has the shape of a convex cone whose dimensions correspond to those of the second cone.

A third embodiment for forming the main body consists in making the main body from a synthetic or composite material, such as a polymer material or a reinforced polymer material. The polymer is chosen from the group including polyoxymethylene, polyamide, polyetheretherketone and polyphenylene sulphide. In the case of a composite material, the reinforcement may, for example, be PTFE or graphite particles, to change the tribological properties of the polymer-based material. Other types of reinforcements can be envisaged, such as, for example, nanoparticles of silicon oxides or other ceramics to mechanically strengthen the base polymer. It is evidently also possible to combine several types of reinforcements with a given polymer. For these types of materials, the material is moulded in a mold corresponding to the desired shape. Thus, the mold has the shape of a convex cone whose dimensions correspond to those of the second cone. The body is obtained by moulding this material in the mold.

Advantageously, the main body of the endstone and the resilient support are formed in one piece. In other words, the main body and the resilient support are made of the same material, for example of amorphous metal, to form a one-piece part.

In a variant, the main body of the endstone is overmoulded on the resilient support. The resilient support is pre-formed by a LIGA-type (from the German 'Röntgenlithographie, Galvanoformung, Abformungtype') lithography, electroplating and moulding process.

Naturally, the invention is not limited to the embodiments described with reference to the Figures and variants could be envisaged without departing from the scope of the invention.

The invention claimed is:

1. A bearing for an arbor or staff (16) of a rotary wheel set of a timepiece movement, the bearing (18, 20) comprising a bearing block (13) provided with a housing (14) and an endstone (22) arranged inside the housing (14), the endstone (22) comprising a main body provided with a cavity configured to receive a pivot (17, 20) of the arbor (16) of the rotary wheel set, the pivot (17, 30) having the shape of a first cone (26) having a first solid angle (31, 36), the apex (29) of the first cone being rounded with a predefined first radius of curvature comprised in a range from 0.2 μm to 50 μm, the cavity having the shape of a second cone (28) having a second solid angle (32) greater than the first solid angle (31, 36), such that the pivot (17, 30) can rotate in the cavity, the apex of the second cone (28) being rounded and having a predefined second radius of curvature, wherein the second radius of curvature is smaller than the first radius of curvature.

2. The bearing according to claim 1, wherein the second radius of curvature is less than 40 μm.

3. The bearing according to claim 1, wherein the second radius of curvature is less than 20 μm.

4. The bearing according to claim 1, wherein the main body of the endstone (22) is formed of a material to be chosen from the following list: an at least partially amorphous metal alloy, an electroformed material, a synthetic material or a composite material.

5. The bearing according to claim 4, wherein the cavity is obtained from a hot deformation process of an at least partially amorphous metal using a tool whose diameter is smaller than the first radius of curvature of the first cone.

6. The bearing according to claim 4, wherein the at least partially amorphous metal alloy is crystallised to create friction-enhancing phases.

7. The bearing according to claim 4, wherein the at least partially amorphous metal alloy is ceramized to harden the surface of the main body, in the second cone (28) of the cavity.

8. The bearing according to claim 4, wherein main body of the electroformed material endstone (22) is obtained from a galvanic growth process, including electroforming in a corresponding mold.

9. The bearing according to claim 4, wherein the main body of the endstone made of synthetic material is obtained by moulding.

10. The bearing according to claim 4, wherein the main body of the endstone (22) made of composite material is obtained by moulding.

11. The bearing according to claim 1, wherein the second solid angle is comprised in a range from 60 to 120°.

12. The bearing according to claim 1, wherein the bearing includes a resilient support (21) for the endstone (22) for dampening shocks.

13. The bearing according to claim 12, wherein the main body of the endstone (22) and the resilient support (21) are formed in one piece.

14. The bearing according to claim 12, wherein the resilient support is formed by a LIGA-type lithography, electroplating and moulding process.

15. The bearing according to claim 12, wherein the main body of the endstone (22) is overmoulded on the resilient support.

16. A rotary wheel set of a timepiece movement, for a bearing (18, 20) according to claim 1, the wheel set being provided with an arbor or staff (16) with at least one pivot (19) having the shape of a first cone (26) having a predefined first solid angle, the apex of the first cone (26) being rounded and having a predefined first radius of curvature, wherein the first radius of curvature is comprised in a range from 0.2 μm to 50.

17. The rotary wheel set according to claim 16, wherein the apex of the first cone (26) of the pivot (19) is cut to form a circular third cone (35), having a third solid angle (42) greater than the first solid angle (32), substantially equal to the second solid angle (31) of the endstone (22).

18. A timepiece movement comprising a plate and at least one bar, said plate and/or the bar comprising an orifice, wherein the movement includes a bearing (22) according to claim 1, the bearing (22) being inserted into the orifice, and a rotary wheel.

* * * * *